US005226638A

United States Patent [19]

Ausilio

[11] Patent Number: 5,226,638

[45] Date of Patent: Jul. 13, 1993

[54] CLAMP ARM WITH SLIP PLANE POSITIONING

[76] Inventor: John S. Ausilio, 37502 Fiore Trail, Mt. Clemens, Mich. 48043

[21] Appl. No.: 891,810

[22] Filed: Jun. 1, 1992

[51] Int. Cl.[5] ..... B25B 1/02

[52] U.S. Cl. ..... 269/238; 269/285

[58] Field of Search ..... 269/282, 238, 285; 228/140

[56] References Cited

U.S. PATENT DOCUMENTS

| | | | |
|---|---|---|---|
| 260,777 | 7/1882 | Patton . | |
| 782,056 | 2/1905 | Richardson | 228/140 |
| 941,543 | 11/1909 | Sistek et al. . | |
| 997,243 | 7/1911 | Daley | 269/282 |
| 2,126,997 | 8/1938 | Kramer | 228/140 |
| 2,579,151 | 12/1951 | Lloyd | 269/282 |
| 2,609,717 | 9/1952 | Maroth | 269/282 |
| 3,454,971 | 7/1969 | Wolf . | |
| 3,838,487 | 10/1974 | Maeda . | |
| 4,052,047 | 10/1977 | Bailey . | |
| 4,376,331 | 3/1983 | Clark . | |
| 4,518,155 | 5/1985 | Lehmann . | |
| 4,834,352 | 5/1989 | Thornton | 269/282 |

*Primary Examiner*—Robert C. Watson

*Attorney, Agent, or Firm*—Basile and Hanlon

[57] ABSTRACT

A clamp having slip plane positioning enables a clamp nose and an attached pressure foot which are initially non-permanently attached to the clamp arm to be brought into a final predetermined coordinate position before the clamp nose is fixedly attached to the clamp arm. The clamp nose has the pressure foot mounted at one end. An open-ended slot is formed at the other end of the clamp nose and slidingly engages opposed side walls of one end of the clamp arm. A fastener threadingly extends through a portion of the clamp nose bounding the slot into engagement with the clamp arm to non-permanently attach the clamp nose to the clamp arm. The clamp nose and the pressure foot are positionally adjusted with respect to the clamp arm at final assembly to bring the pressure foot into a predetermined coordinate position before the clamp nose is fixedly secured to the clamp arm.

8 Claims, 2 Drawing Sheets

CLAMP ARM WITH SLIP PLANE POSITIONING

BACKGROUND OF THE INVENTION

1. Field of the Invention

The present invention relates, in general, to clamps and, more specifically, to pivotal clamps for holding a workpiece during manufacturing operations.

2. Background Description

Clamps are widely employed to hold two or more parts together during a manufacturing operation. In automotive assembly plants, for example, clamps are used to hold two or more metal sheets or parts together under pressure and at a predetermined coordinate position during welding, piercing, hemming and other manufacturing operations.

Typically, such clamps include a riser which is mounted via a mounting plate to a tool base. A clamp with at least one pivotal clamp arm is mounted on the upper end of the riser and is movable between an open position and a closed, workpiece engaging position, either manually or under power by means of a fluid cylinder, for example. In such a clamp, two pressure feet or N/C blocks are respectively mounted on one end of the clamp arm through a clamp nose member attached to the pivotal clamp arm and to the upper end of the riser to establish a predetermined coordinate position therebetween when the clamp arm is moved to the closed position bringing the pressure feet into engagement with the workpiece.

Due to close tolerances required for accurate automobile assembly, the pressure feet, clamp arm and clamp nose are usually specifically designed and machined to specified dimensions and tolerances for each application. A typical clamp construction includes a clamp nose having a slot extending inward from one end which engages opposite side walls of one end of the pivotal clamp arm. All mating surfaces on the clamp arm and the clamp nose require machining to insure accurate final assembly dimensions when the clamp nose is welded to the clamp arm. Furthermore, the pressure foot is attached to the opposite end of the clamp nose either directly or indirectly by means of an intermediate mounting bracket. Again, all mating surfaces between the clamp nose and the pressure foot require precision machining for accurate buildup dimensions in the clamp.

These special clamp parts require additional design time to create drawings for each part of each clamp. Additional time is also required to machine each part to the prescribed dimensions prior to assembly of the clamp. All of such design and machining time contributes to the cost of the clamp. Furthermore, at final assembly, dimensional differences between the clamp and the sheet metal often require additional machining and/or the use of shims to position the pressure feet at the desired coordinate positions.

Thus, it would be desirable to provide a clamp for manufacturing operations which is constructed of as many standard parts as possible so as to reduce design, construction and assembly time of the clamp. It would also be desirable to provide a clamp which can be loosely assembled prior to welding of the clamp parts in the desired coordinate positions at final assembly of the clamp at the use site.

SUMMARY OF THE INVENTION

The present invention is a clamp having slip plane positioning which enables the clamp nose and pressure foot of the clamp, which are initially loosely attached to the clamp arm, to be brought into a final, predetermined coordinate position with respect to a workpiece before the clamp nose is fixedly attached to the clamp arm.

The clamp includes a base having a clamp arm pivotally mounted thereon. The clamp arm is movable between first and second positions. A clamp nose is adjustably engageable with one end of the clamp arm. A pressure foot is attached to one end of the clamp nose and includes a workpiece engaging surface which engages the workpiece when the clamp is moved to the second, closed position. Means are provided for non-permanently securing the clamp nose to the clamp arm prior to final adjustment and the fixed attachment of the clamp nose to the clamp arm.

In a preferred embodiment, the slot is formed between first and second legs at one end of the clamp nose. The non-permanent securing means comprises a set screw threadingly extendable through one of the first and second legs on the clamp nose into releasable engagement with the clamp arm to non-permanently attach the clamp nose to the clamp arm. When the clamp nose and pressure foot are brought into the desired final coordinate position in engagement with the workpiece at final assembly of the tool containing the clamp, the clamp nose is permanently fixed to the clamp arm by welds at various locations on the clamp nose and clamp arm.

In the method of constructing a clamp according to the present invention, the method includes the steps of:

A. Pivotally mounting a clamp arm to a base for movement between first and second positions;

B. Attaching a pressure foot having a workpiece engageable surface to one end of a clamp nose;

C. Slidably engaging the clamp nose to one end of the clamp arm;

D. Non-permanently attaching the clamp nose to the clamp arm;

E. Moving the clamp arm, the clamp nose and the pressure foot into a final, predetermined workpiece engaging coordinate position;

F. Adjusting the position of the clamp nose and pressure foot with respect to the clamp arm to place the pressure foot at the desired predetermined coordinate position with respect to the workpiece; and G. Lastly, fixedly attaching the clamp nose to the clamp arm.

The clamp of the present invention affords many advantages over previously devised clamps used in manufacturing operations, such as clamps employed in the assembly of automotive vehicles. The clamp of the present invention is formed of a number of standardized components which reduces design time required for special components for each application as well as the associated machining of such specially designed components for mating engagement with other components of the clamp. The clamp of the present invention uniquely enables the clamp nose and attached workpiece engaging pressure foot to be non-permanently attached to the clamp arm during initial tryout and assembly and then brought into a final, predetermined coordinate position for engagement with a workpiece at final assembly before the clamp nose is permanently attached to the clamp arm. This eliminates the need for machining portions of the clamp or the use of shims at final assembly to bring the pressure foot into the desired coordinate position with respect to the workpiece. All of these factors contribute to a reduced overall cost for designing, constructing and installing a clamp for use in a manufacturing operation.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENT

Figure 1:
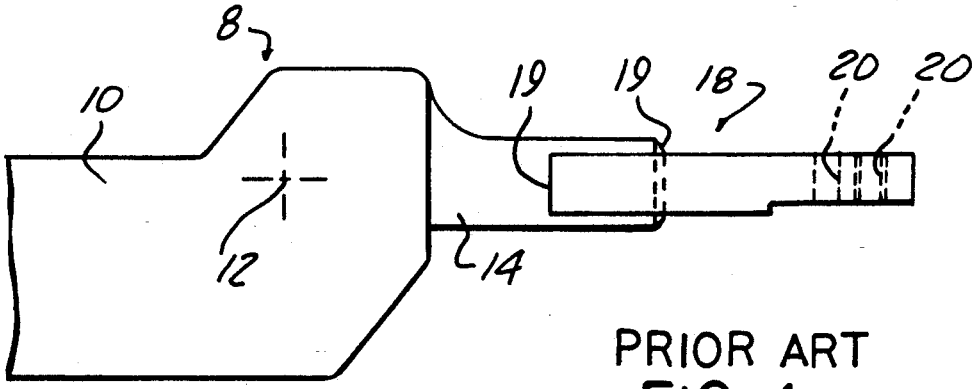
PRIOR ART FIG-1
FIG. 1 is a partial, side elevational view of a prior art clamp arm and clamp nose.
Figure 2:
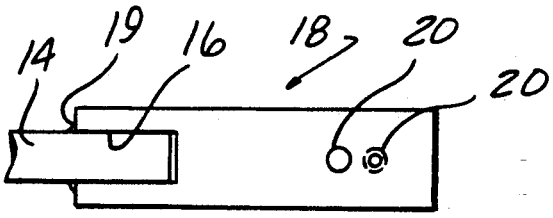
PRIOR ART FIG-2
FIG. 2 is a partial, plan view of the prior art clamp arm and clamp nose shown in FIG. 1.

Referring now to FIGS. 1 and 2, there is illustrated a prior art clamp 8 which is mountable on a suitable base, not shown, and movable between a first, open position and a second closed position, by manual or powered means, also not shown. Prior art clamps, such as the clamp 8 shown in FIGS. 1 and 2, typically include a clamp arm 10 which is pivotally mounted about a pivot point 12 to a base attached to a tool or work station. One end of the clamp arm 10, which is not depicted in FIG. 1, is connected to a power drive means, such as a fluid cylinder, for pivoting the clamp arm 10 between open and closed or first and second positions, respectively. A small end extension 14 is integrally formed with or joined to the clamp arm 10 and extends outward therefrom. The outer end of the end extension 14 slidably engages a slot 16 formed in one end of a clamp nose 18. The clamp nose 18 is fixedly joined to the end extension 14 by means of welds denoted by reference number 19 which are formed at a number of different locations at the juncture of adjoining surfaces of the end extension 14 and the clamp nose 18.

The mating side wall surfaces of the end extension 14 and the portion of the clamp nose 18 forming the slot 16 are machined to precise dimensions for accurate dimensional assembly of the clamp. At least one and preferably two bores, both denoted generally by reference number 20, are formed in the opposite end of the clamp nose 18. The bores 20 receive suitable fasteners, not shown, for attaching a pressure foot or N/C block, also not shown, to the clamp nose 18. The pressure foot has a workpiece engaging surface for securely engaging a workpiece when the clamp 8 is moved to the second closed position thereby holding the workpiece under pressure in a fixed dimensional coordinate position during manufacturing operations on the workpiece.

While this construction affords a clamp which is effective in manufacturing operations, the machining required between the mating surfaces of the end extension 14 and the slot 16 in the clamp nose 18 requires additional design time to prepare detailed drawings for each separate part of the clamp 8 as well as additional machining time to form the parts to the desired dimensions. Furthermore, the clamp nose 18 is fixed to the end extension 14 by welds 19 during initial assembly of the tool containing the clamp 8. When the tool is moved into its final workstation, it is common for the clamp 8 to require additional adjustments to bring the pressure foot attached to the clamp nose 18 into the desired dimensional coordinate position with respect to a workpiece. This usually results in machining of the pressure foot and/or clamp nose or the use of additional metal shims. This increases the assembly time of the clamp and, thereby, the overall cost of the clamp 8. As numerous clamps are usually contained in each tool, the overall cost of the tool is accordingly increased by the additional design, assembly and installation time required for each clamp.

As shown in FIGS. 3, 4, 5 and 6, a clamp 30 is depicted which overcomes the problems described above with respect to previously devised clamps in that the clamp may be constructed with reduced design time, assembly time and installation time. In general, the clamp 30 is provided with slip plane positioning of the clamp nose and pressure foot with respect to the clamp arm to enable the clamp nose and pressure foot to be brought into a final specific dimensional coordinate position with respect to a workpiece during final assembly before the clamp nose is fixedly connected to the clamp arm.

Figure 3:
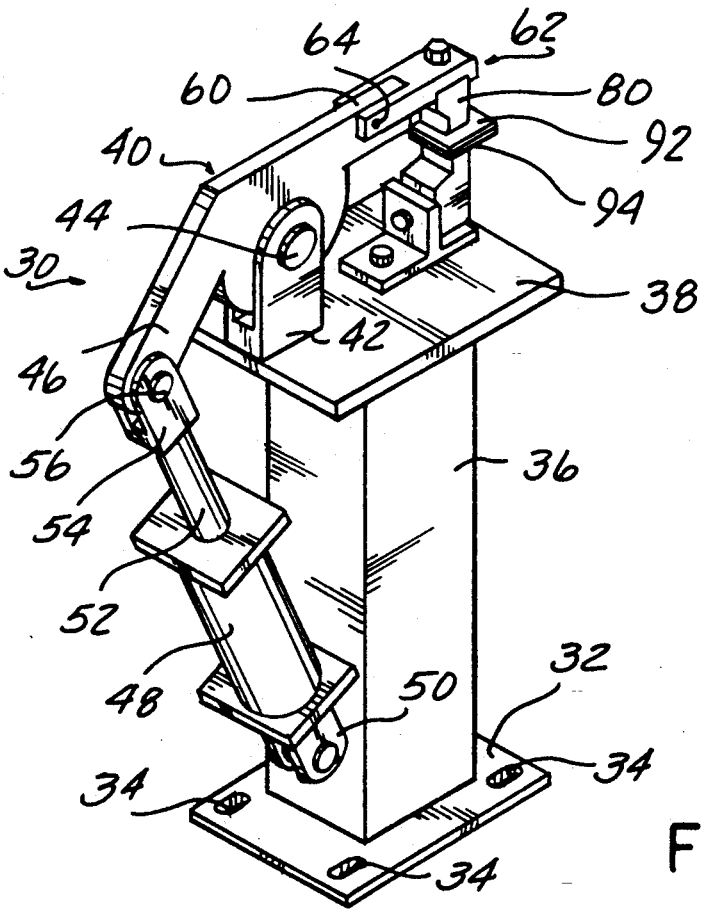
FIG. 3 is a perspective view of a clamp constructed according to the method of the present invention.
Figure 4:
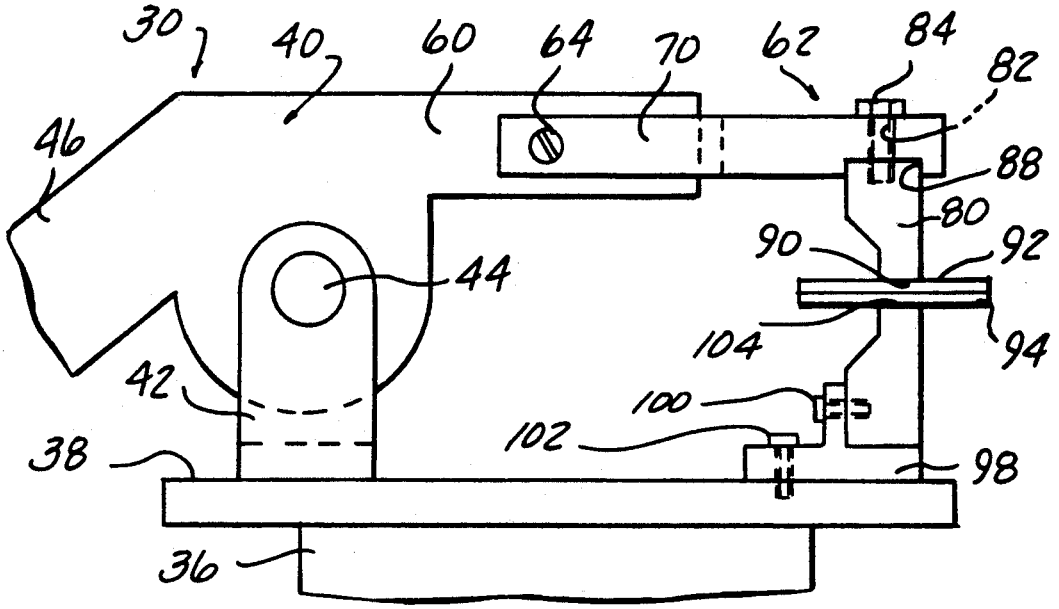
FIG. 4 is a partial, side elevational view of the clamp shown in FIG. 3.
Figure 5:
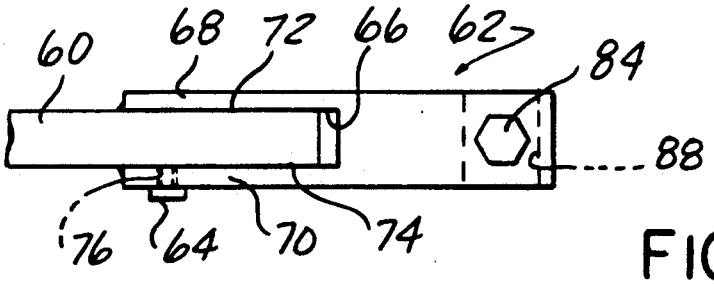
FIG. 5 is a partial, plan view of the clamp shown in FIG. 4.
Figure 6:
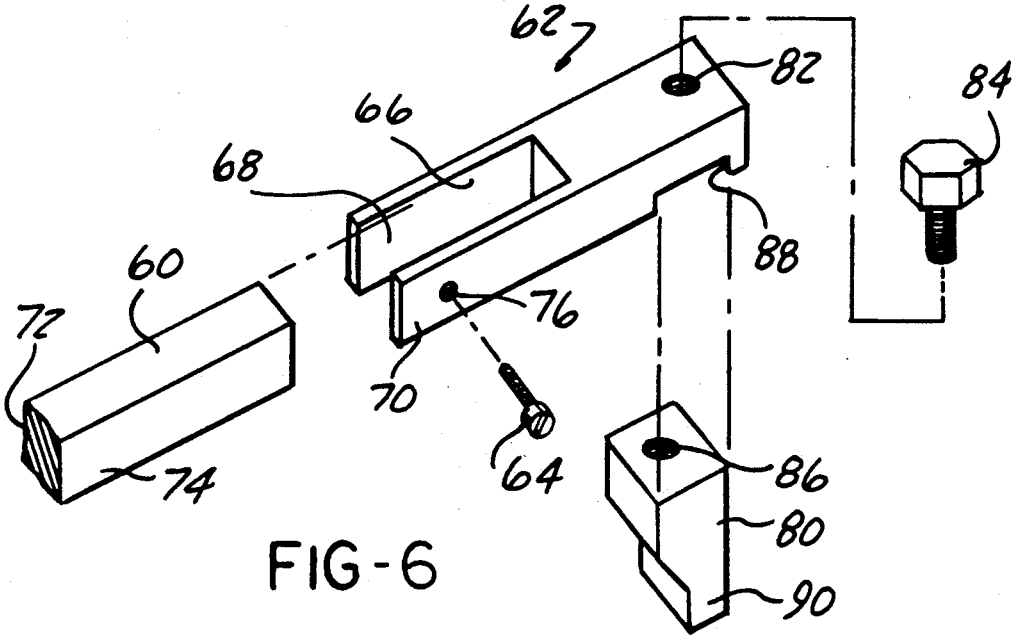
FIG. 6 is a partial, exploded, perspective view showing the assembly of the clamp arm, clamp nose and pressure foot.

As shown in FIGS. 3 and 4, the clamp 30 includes a base or weldment which is depicted in one exemplary embodiment. The weldment includes a lower mounting plate 32 having apertures 34 formed therein which receive fasteners to attach the clamp 30 to a tool or base. A riser 36 of any form and construction is attached to the lower mounting plate 32 and extends outward therefrom. The riser 36 may be in the form of the illustrated tubular member; but also can be formed of welded plates, etc. The riser 36 is formed with a predetermined length so as to position an upper mounting plate 38 which is attached to one end of the riser 36 at a predetermined dimension with respect to the tool. A pivotal clamp arm 40 is pivotally mounted on the upper mounting plate 38 and is movable between a first open position to a second closed position as shown in FIGS. 3 and 4.

By way of example only, a trunion 42 is mounted on the upper mounting plate 38 and carries a pivot pin 44 which extends through an intermediate portion of the clamp arm 40 for pivotally mounting the clamp arm 40 to the upper mounting plate 38 on the riser 36. A first end 46 of the clamp arm 40 extends outward from the pivot pin 44 and is attached to a power moving means 48. The power moving means 48 may be any suitable power source, such as a fluid, i.e., air or hydraulic, cylinder. As is conventional, the cylinder is connected at one end by a trunion 50 attached to the riser 36 on the lower mounting place 32. An extensible rod 52 in the cylinder carries another trunion 54 at its outer end which is pivotally connected by means of a pivot pin 56 to the first end 46 of the clamp arm 40. In this manner, retraction of the rod 52 into the cylinder 48 will cause the clamp arm 40 to pivot about the pivot pin 44 and move the other end of the clamp arm 40 to the first, open position. Extension of the piston rod 52 to the position shown in FIG. 3 will cause the clamp arm 40 to pivot to the second, closed position bringing the attached components of the clamp 30, described hereafter, into engagement with a workpiece.

It will also be understood that the clamp arm 40 may be manually moved between the first and second positions in which instance the first end 46 acts as or is connected to a handle for pivoting the clamp arm 40.

The clamp arm 40 includes a second end 60 which extends outward from the pivot point 44 opposite from the first end 46. A clamp nose denoted in general by reference number 62 slidably engages the second end 60 of the clamp arm 40 and is non-permanently attached thereto, prior to final assembly, by a non-permanent securing means 64. A slot 66 is formed in one end of the clamp nose 62 and extends from the one end of the clamp nose 62. The slot 66 forms first and second spaced legs 68 and 70, respectively, disposed on opposite sides of the slot 66. The slot 66 is dimensioned to closely, but slidably engage opposed side surfaces 72 and 74 on the second end 60 of the clamp arm 40.

An aperture 76 is formed in the leg 70 of the clamp nose 62 and threadingly receives the non-permanent securing means 64, which is depicted by way of example only as being a set screw. The set screw 64 threadingly extends through the aperture 76 in the leg 70 of the clamp nose 62 into non-permanent, temporary engagement with the side wall 74 of the second end 60 of the clamp arm 40 to non-permanently hold the clamp nose 62 to the clamp arm 40. This non-permanent engagement, on the other hand, also provides slip plane positioning of the clamp nose 62 with respect to the clamp arm 40 such that the clamp nose 62 may be moved longitudinally with respect to the second end 60 of the clamp arm 40 as well as vertically with respect to the second end 60 of the clamp arm 40 to bring the outer end of the clamp nose 62 and the attached pressure foot into any desired dimensional coordinate position with respect to a workpiece, as described hereafter.

An upper pressure foot or N/C block 80 is attached to the outer end of the clamp nose 62 by suitable means. By way of example only, a bore 82 is formed in the outer end of the clamp nose 62 and receives a fastener 84 therethrough which engages a corresponding bore 86 in the upper end of the pressure foot 80. A slot 88 may be formed in the lower surface of the clamp nose 62 for slidingly receiving the upper end of the pressure foot 80. The lower surface 90 of the pressure foot 80 is formed as a workpiece engaging surface and has a shape complimentary to the shape of the workpiece. By way of example only, the workpiece with which the clamp 30 of the present invention is to be used, is depicted as comprising a stack of two metal sheets 92 and 94.

A lower pressure foot or N/C Block 96 has a shape similar to that of the upper pressure foot 80; but is inverted so as to engage the lower metal sheet 94, as shown in FIGS. 3 and 4. The lower pressure foot 96 is connected to a bracket 98 by means of suitable fasteners 100. The bracket 98, meanwhile, is mounted by fasteners 102 or by welds to the upper mounting plate 38 on the riser 36.

The upper surface 104 of the lower pressure foot 96 also serves as a workpiece engaging surface and has a shape complimentary to the shape of the lower metal sheet 94 at its point of contact with the lower metal sheet 94. The workpiece engaging surfaces 90 and 104 of the upper and lower pressure feet 80 and 96, respectively, are spaced apart a predetermined dimension or distance equal to the thickness of the stack of metal sheets 92 and 94. This dimension and the position of both pressure feet 80 and 96 must be accurately maintained in order to assemble the metal sheets 92 and 94 into their desired configuration.

The upper and lower pressure feet 80 and 96 may be formed of any suitable material, such as a high strength steel which is machined to the desired configuration. Alternately, urethane and composite materials may also be employed to form the pressure feet 80 and 96 to the desired configuration, without the need for additional machining or forming operations.

In assembling the clamp 30 of the present invention, standardized components including the upper and lower mounting plates 38 and 34, respectively, and the riser 36 are constructed. The drive means 48, in the case of a powered clamp, is then attached at one end to the riser 36, as shown in FIG. 3 and described above. The clamp arm 40 is then pivotally attached to the upper mounting plate 38 and the first end 46 thereof attached to the drive means 48. Activation and deactivation of the drive means 48 causes reciprocal extension and retraction of the piston rod 52 which results in pivotal movement of the clamp arm 40 between the first and second positions.

The upper pressure foot 80 is then attached to the clamp nose 62 by sliding the upper end of the pressure foot 80 into the slot 88 in the clamp nose 62 and joining the pressure foot 80 to the clamp nose 62 by means of the fastener 84. The clamp nose 62 with the attached upper pressure foot 80 is then slidingly engaged with the second end 60 of the clamp arm 40 by bringing the spaced legs 68 and 70 of the clamp nose 62 into engagement with opposed side wall surfaces 72 and 74, respectively, of the second end 60 of the clamp arm 40. The non-permanent securing means, such as the set screw 64, is then threadingly engaged through the aperture 76 in the second leg 70 of the clamp nose 62 into releasable engagement with the side wall 74 of the clamp arm 40. This holds the clamp nose 62 in a non-permanent position with respect to the clamp arm 40; but enables the clamp nose 62 on the attached upper pressure foot 80 to be urged into other positions during final assembly of the clamp to bring the upper pressure foot 80 into a desired dimensional coordinate position with respect to the workpiece and the lower pressure foot 96.

During final assembly, the clamp arm 40 is pivoted to the closed position shown in FIGS. 3 and 4, bringing the upper pressure foot 80 into proximity with or in contact with the upper metal sheet 92. If adjustments are needed, the set screw 64 can be loosened to enable the clamp nose 62 and the attached upper pressure foot 80 to be moved either or both longitudinally outward or inward with respect to the clamp arm 40 as well as vertically with respect to the clamp arm 40 or to any angular position with respect to the clamp arm 40 to bring the upper pressure foot 80 into the desired dimensional relationship with respect to the metal sheets 92 and 94 and/or the lower pressure foot 96.

The slip plane positioning afforded by the initial non-permanent attachment of the clamp nose 62 and the upper pressure foot 90 to the clamp arm 40 enables the use of standardized components to form the clamp and thereby minimizes the requirement for detailed drawings of each specially designed clamp component. Assembly time for constructing the clamp 30 is also reduced as compared to previous clamp constructions, since special machining of mating surfaces of the clamp components is not required or is done on standardized components. Further, special machining or the use of shims to bring the upper pressure foot 80 into the desired dimensional coordinate position with respect to the lower pressure foot 96 during initial assembly of the clamp and associated tooling is not required. This minimizes construction time for the clamp thereby adding to the cost savings for the clamp 30 of the present invention. Finally, the slip plane positioning enables the upper pressure foot 80 to be moved into the desired coordinate position with respect to the workpiece, such as the stack of metal sheets 92 and 94, and the lower pressure foot 96 at final assembly in the manufacturing plant without the need for additional machining and/or the use of shims to effect such dimensional positioning.

What is claimed is:

1. A clamp for engaging a workpiece comprising:

a base;

a clamp arm pivotally mounted on the base and pivotal between first and second positions;

a clamp nose adjustably engageable with one end of the clamp arm;

a pressure foot mounted on the clamp nose for engaging a workpiece when the clamp arm is in the second position;

means for non-permanently securing the clamp nose to the clamp arm in an adjustably selectible position with respect to the base; and means for permanently attaching the clamp nose to the clamp arm in a predetermined coordinate position with respect to a workpiece.

2. The clamp of claim 1 wherein the non-permanent securing means comprises:

a fastener threadingly extendable through the clamp nose into releasable engagement with the clamp arm.

3. The clamp of claim 2 wherein:

first and second spaced legs are formed at one end of the clamp nose forming a slot, the first and second legs slidingly engageable with the one end of the clamp arm; and the fastener is extendable through one of the first and second legs into releasable engagement with the clamp arm.

4. The clamp of claim 1 wherein the permanent attaching means comprises:

welds formed at predetermined locations on the clamp nose and clamp arm to fixedly attach the clamp nose to the clamp arm.

5. A clamp for engaging a workpiece comprising:

a base;

a clamp arm pivotally mounted on the base and pivotal between first and second positions;

a clamp nose adjustably engageable with one end of the clamp arm;

first and second legs formed on one end of the clamp nose and defining a slot therebetween, the first and second legs being slidably engageable with one end of the clamp arm;

a fastener threadingly extendable through one of the first and second legs on the clamp nose into releasable, non-permanent engagement with the one end of the clamp arm to non-permanently attach the clamp nose to the clamp arm in an adjustably selectible position with respect to the base; and welds formed at predetermined locations on the clamp nose and the clamp arm to permanently attach the clamp nose to the clamp arm when the pressure foot has been brought into a predetermined coordinate position with respect to a workpiece.

6. The clamp of claim 1 further comprising:

means, formed on at least one of the clamp nose and the clamp arm, for adjustably mounting the clamp nose on the clamp arm such that the clamp nose is movable along any of two perpendicular axes with respect to the clamp arm.

7. A clamp for engaging a workpiece made by the method comprising the steps of:

pivotally mounting a clamp arm on a base for movement between first and second positions;

attaching a pressure foot engageable with a workpiece to one end of a clamp nose;

then adjustably engaging the clamp nose with one end of the clamp arm;

then non-permanently securing the clamp nose to the clamp arm in an adjustably selectible position with respect to the base;

then adjusting the position of the clamp nose and the pressure foot with respect to the clamp arm to place the pressure foot at a predetermined coordinate position with respect to a workpiece; and lastly, permanently attaching the clamp nose to the clamp arm in the predetermined coordinate position with respect to the workpiece.

8. The claim of claim 7 wherein the step of permanently attaching the clamp nose to the clamp arm comprises:

welding the clamp nose to the clamp arm.

* * * * *